US009101790B2

(12) United States Patent
Parnell

(10) Patent No.: US 9,101,790 B2
(45) Date of Patent: Aug. 11, 2015

(54) SPECIAL UPPER BODY EXERCISE DEVICE

(76) Inventor: Tim Parnell, Alexandria, IN (US)

( * ) Notice: Subject to any disclaimer, the term of this patent is extended or adjusted under 35 U.S.C. 154(b) by 181 days.

(21) Appl. No.: 13/467,148

(22) Filed: May 9, 2012

(65) Prior Publication Data

US 2013/0217551 A1 Aug. 22, 2013

Related U.S. Application Data

(60) Provisional application No. 61/600,736, filed on Feb. 20, 2012.

(51) Int. Cl.

| | |
|---|---|
| ***A63B 71/00*** | (2006.01) |
| ***A63B 26/00*** | (2006.01) |
| ***A63B 23/14*** | (2006.01) |
| ***A63B 21/02*** | (2006.01) |
| ***A63B 21/04*** | (2006.01) |
| ***A63B 21/00*** | (2006.01) |
| ***A63B 21/002*** | (2006.01) |
| ***A63B 21/055*** | (2006.01) |
| ***A63B 22/20*** | (2006.01) |
| ***A63B 23/12*** | (2006.01) |

(52) U.S. Cl.

CPC ..... *A63B 21/00061* (2013.01); *A63B 21/0023* (2013.01); *A63B 21/00065* (2013.01); *A63B 21/00178* (2013.01); *A63B 21/0442* (2013.01); *A63B 21/0555* (2013.01); *A63B 21/0557* (2013.01); *A63B 21/1469* (2013.01); *A63B 22/203* (2013.01); *A63B 23/1236* (2013.01); *A63B 2210/58* (2013.01); *A63B 2225/09* (2013.01)

(58) Field of Classification Search

CPC .. A63B 23/1227; A63B 1/00; A63B 22/0002; A63B 22/20; A63B 23/02; A63B 23/03525; A63B 23/12; A63B 23/1209; A63B 23/1236

USPC ..... 482/141, 131, 92

See application file for complete search history.

(56) References Cited

U.S. PATENT DOCUMENTS

| | | | | |
|---|---|---|---|---|
| 2,666,640 | A | 1/1954 | Jennings et al. | |
| 3,572,701 | A | 3/1971 | Agamian | |
| 4,111,417 | A * | 9/1978 | Gardner | 482/128 |
| 4,720,100 | A | 1/1988 | Du Buy | |
| 4,900,015 | A | 2/1990 | Dissinger | |
| 4,911,430 | A | 3/1990 | Flament | |
| 6,616,583 | B1 | 9/2003 | Stack | |
| 7,125,367 | B1 * | 10/2006 | Stearns | 482/141 |
| 7,134,987 | B2 * | 11/2006 | Goldstein | 482/141 |
| 7,645,218 | B2 * | 1/2010 | Potok | 482/141 |
| 7,892,158 | B2 * | 2/2011 | Varga | 482/141 |

(Continued)

*Primary Examiner* — Loan H Thanh
*Assistant Examiner* — Megan Anderson
(74) *Attorney, Agent, or Firm* — John D. Ritchison

(57) ABSTRACT

A special upper body exercise device for performing exercises such as push-ups or the like. It is an isometric and muscle toning push-up machine that allows for the movement of the hands and arms of the user, while performing push-up type exercises in a prone position. The preferred embodiment is comprised of (a) a pair of support sleds with features; (b) a pair of handles, one each for each said sled; (c) a means to pivotally secure the respective handle to the sled; (d) a lateral support system with telescopic features for the supporting sleds as the sleds move essentially in a plane in a lateral direction; (e) a means for slidably connecting the support system to the sleds; and (f) a means for resisting movement of the sleds on the support system wherein the person may grip the handles and exercise. An alternative is foldable.

6 Claims, 12 Drawing Sheets

(56) References Cited

U.S. PATENT DOCUMENTS

Figure 1:
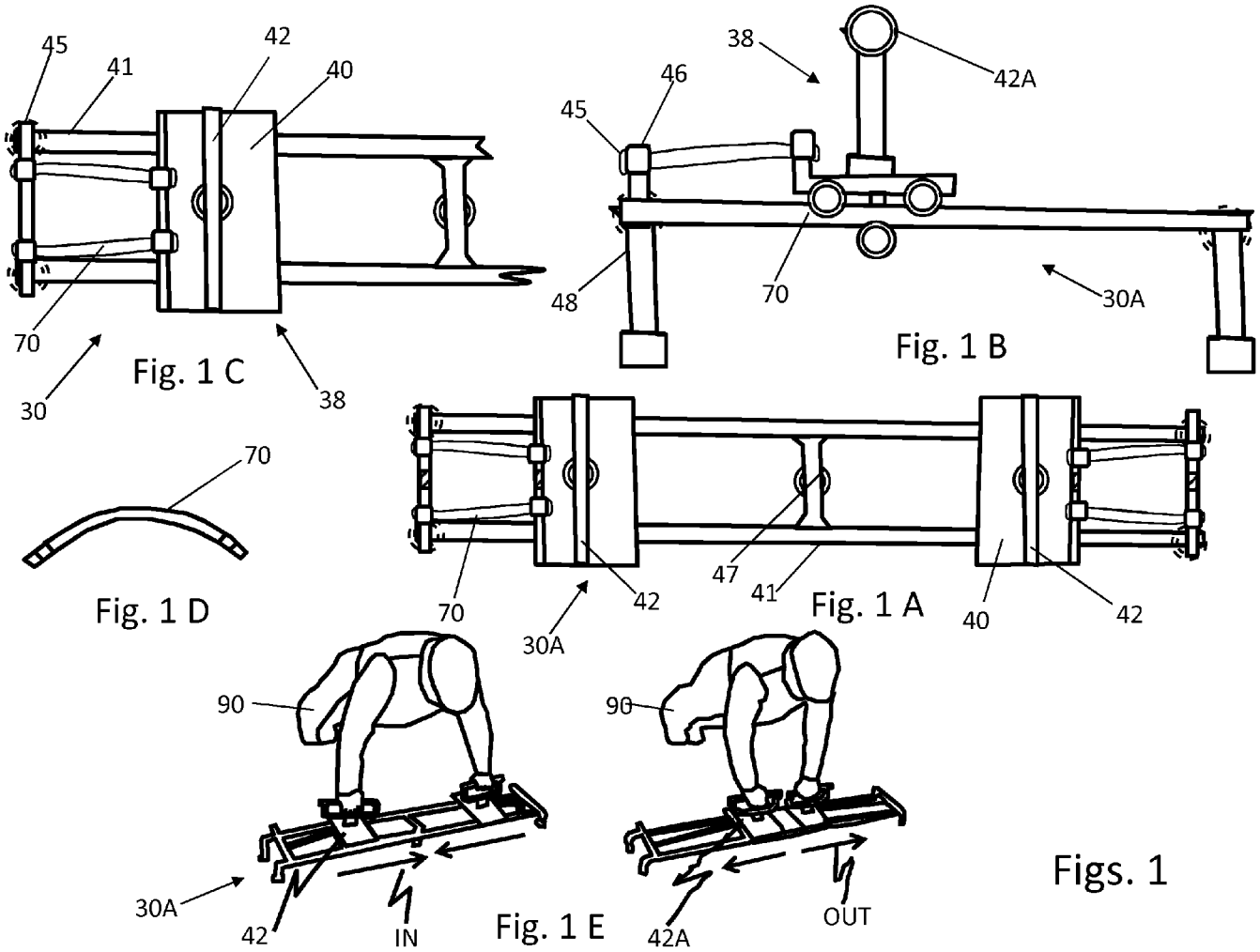

| | | | | |
|---|---|---|---|---|
| 7,931,570 | B2 * | 4/2011 | Hoffman | 482/123 |
| 8,137,251 | B2 * | 3/2012 | Tozzi | 482/141 |
| 2004/0053752 | A1 * | 3/2004 | Yang | 482/70 |
| 2005/0272563 | A1 | 12/2005 | Liang | |
| 2012/0277075 | A1 * | 11/2012 | Ho | 482/141 |
| 2013/0252790 | A1 * | 9/2013 | Sutton | 482/131 |
| 2014/0162857 | A1 * | 6/2014 | Shade | 482/141 |

* cited by examiner

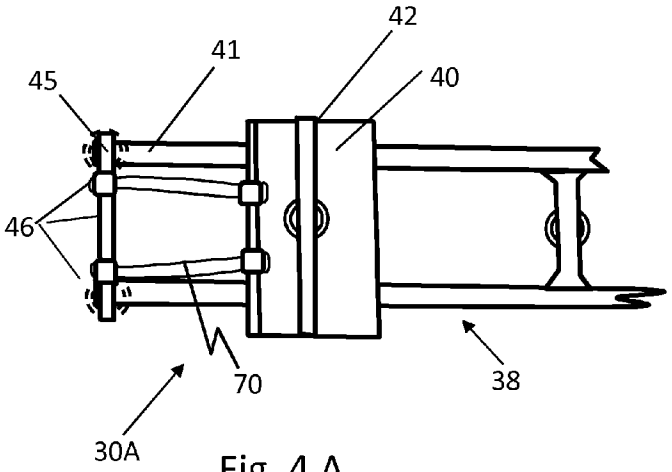
Fig. 4 A
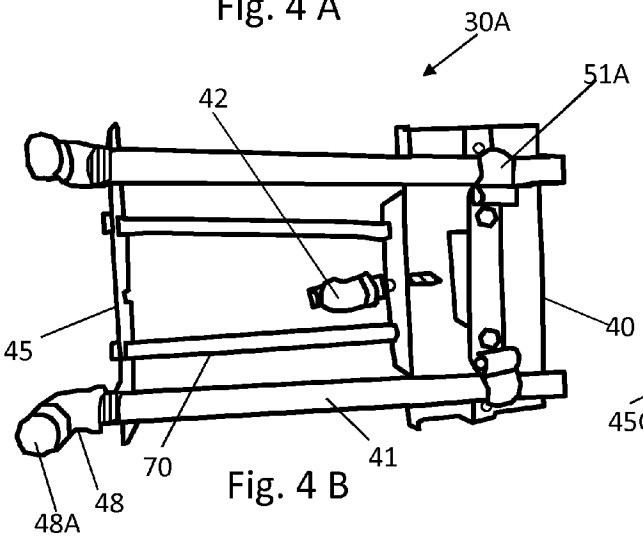
Fig. 4 B
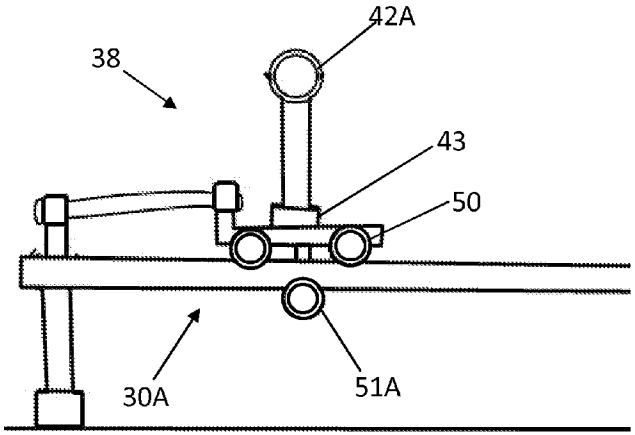
Fig. 4 C
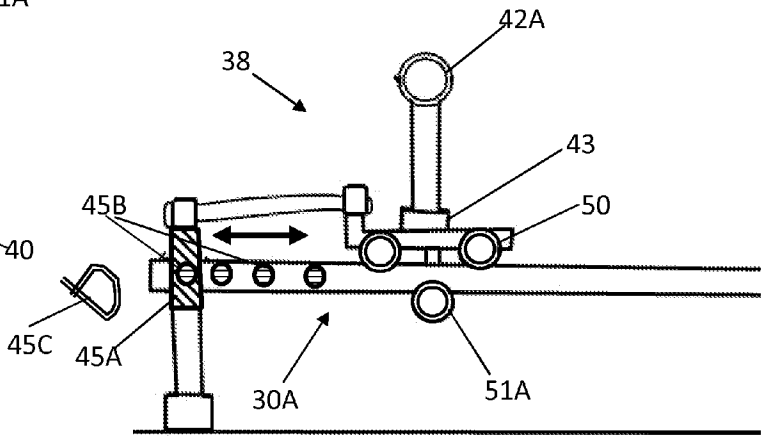
Fig. 4 D
Figs. 4

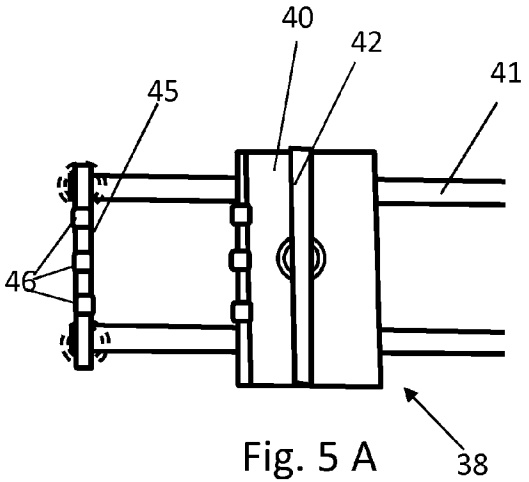
Fig. 5 A
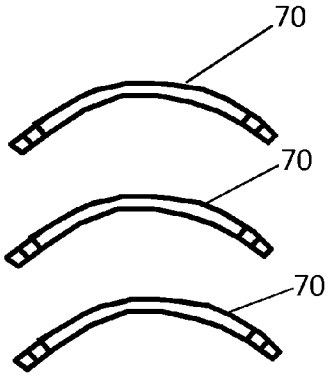
Fig. 5 B
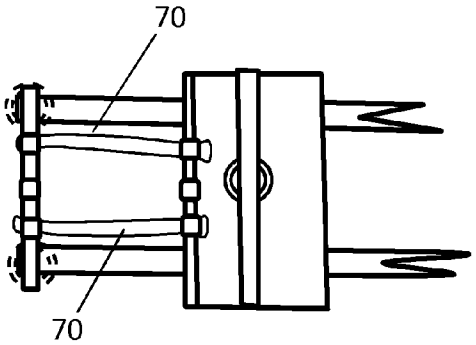
Fig. 5 C
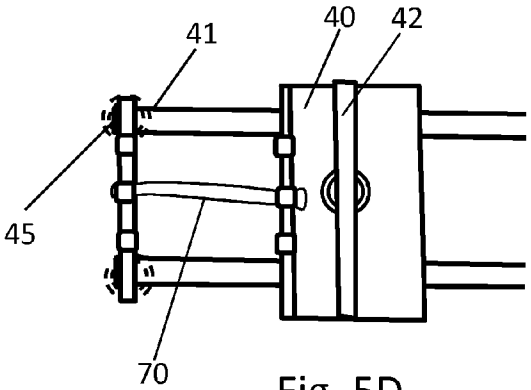
Fig. 5D
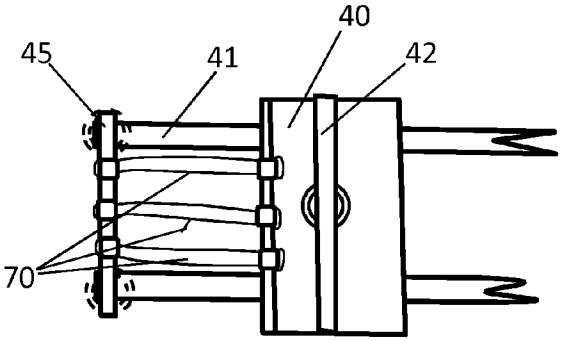
Fig. 5 E
Figs. 5

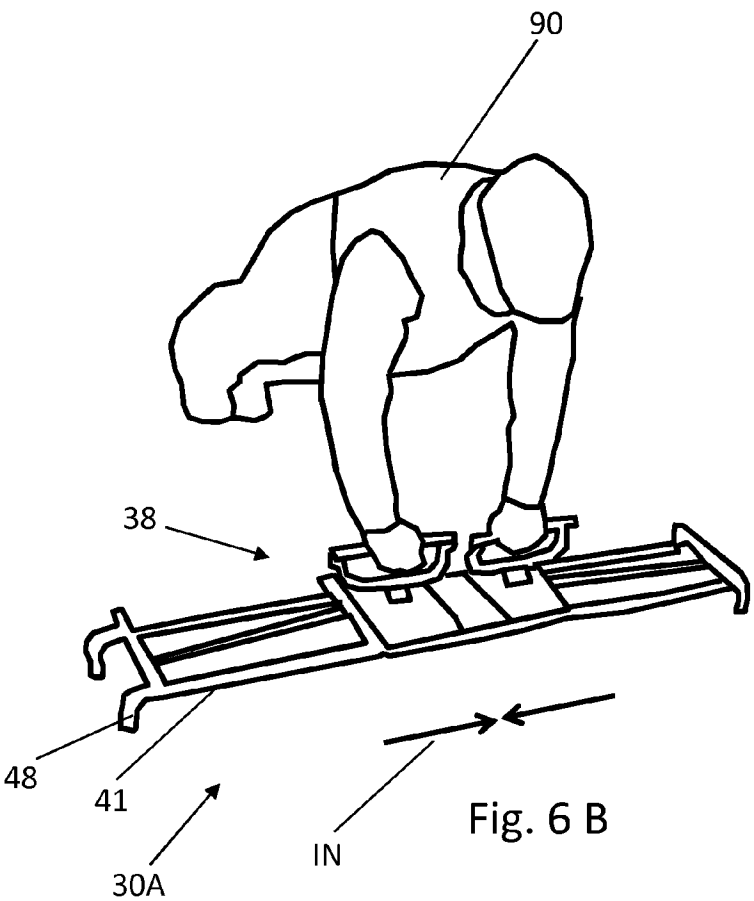
Fig. 6 B
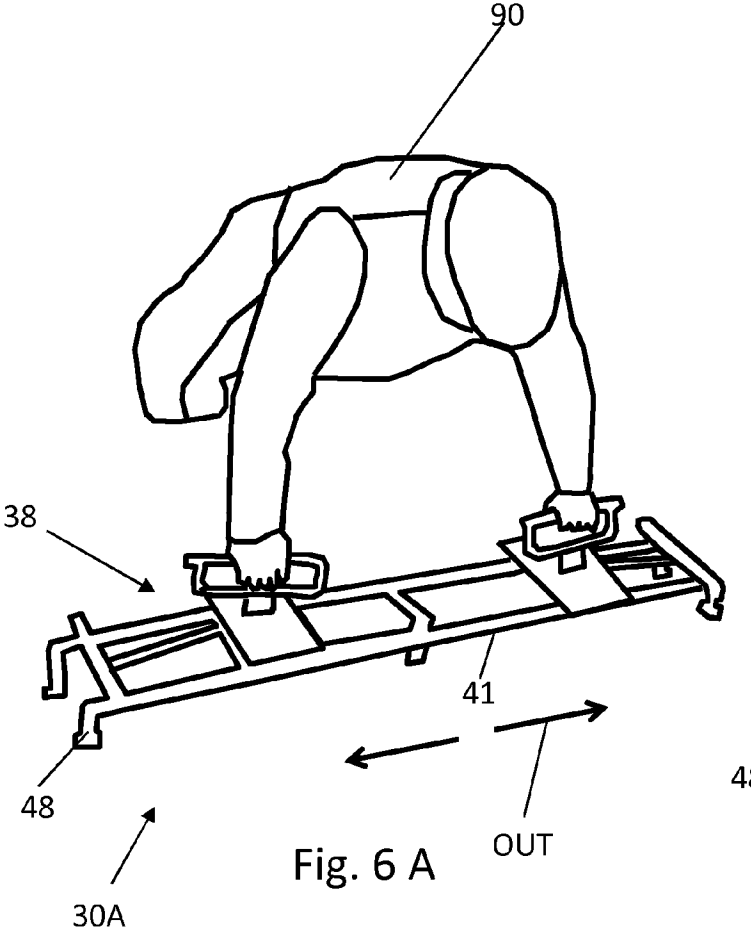
Fig. 6 A
Figs. 6

42
38
70
45
A
A
30
42
47
41
48
48A
B
B 42A
42
60
50
43
40
48
48A
80
30

38
42B
43
42
50
40
41
51
30

Section BB
42
42B
43
46
40
45
41
48
30
48A

Section A-A

71
No. 1
72
No. 2
73
No. 3
74
No. 4
75
No. 5
76
No. 6
77
No. 7

38
40
42
42B
70
51

38
40
42
42B
70
51

38
40
42
42B
70
45
51A

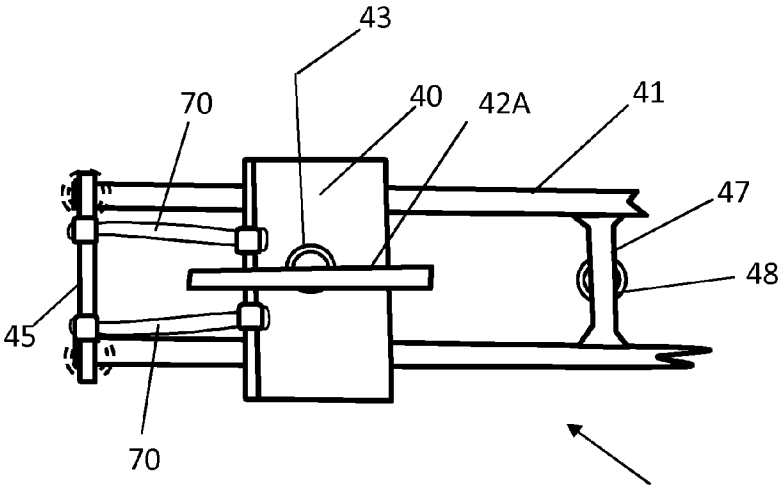
Fig. 9 B
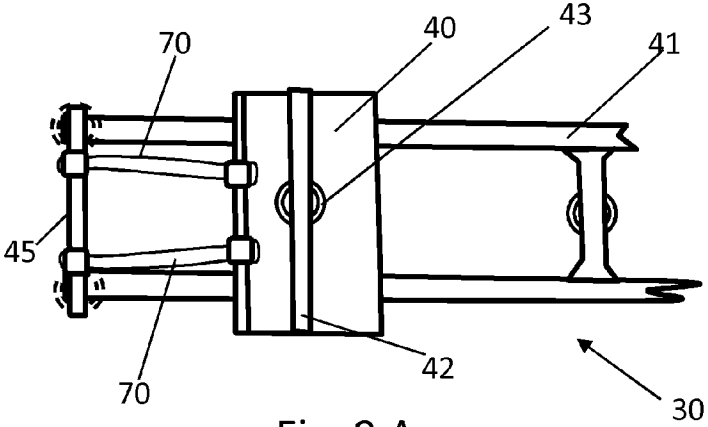
Fig. 9 A
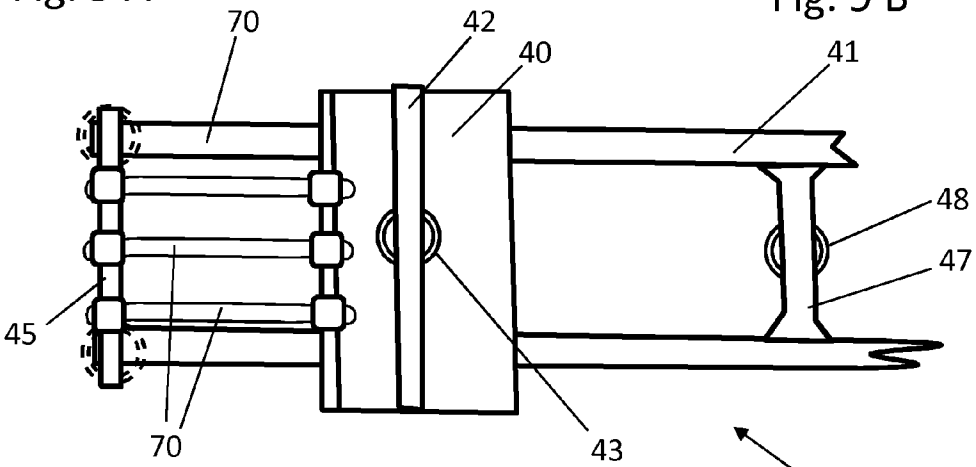
Fig. 9 C
Figs. 9

70
70A
70A
70

42A
50
73, 76
51

42
40
38
50
41
51
41

Section C - C
70A
70A
45

Section B - B
46
45

Section A - A
A
A
B
B
C
C
48
48A
40
50
42
51
38
86
85

SIDE SKETCH

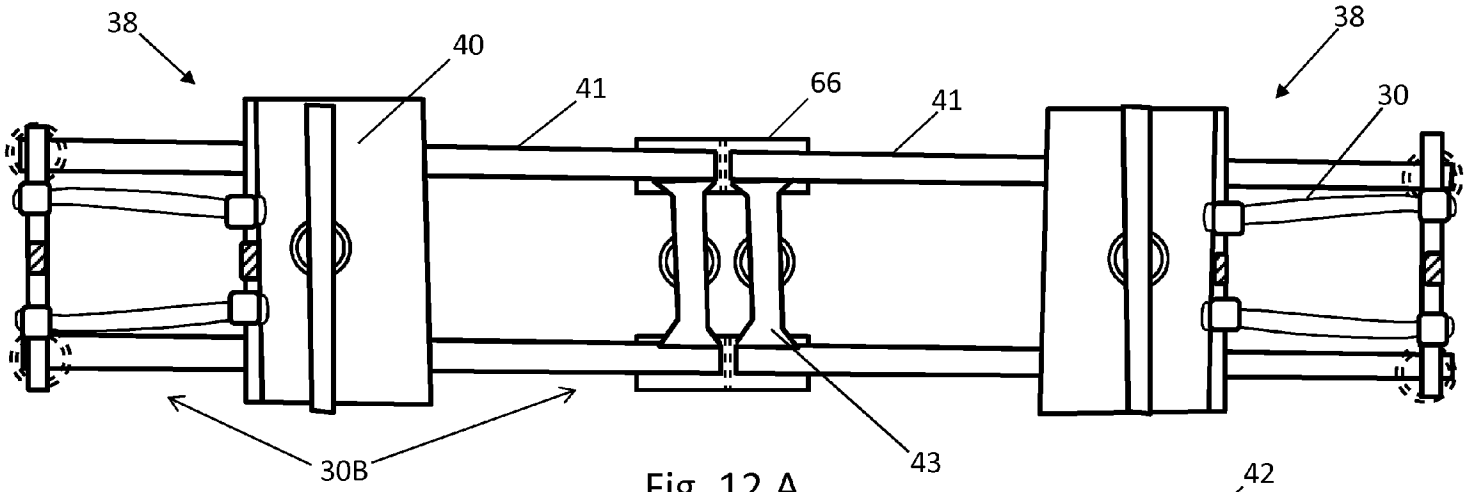
Fig. 12 A
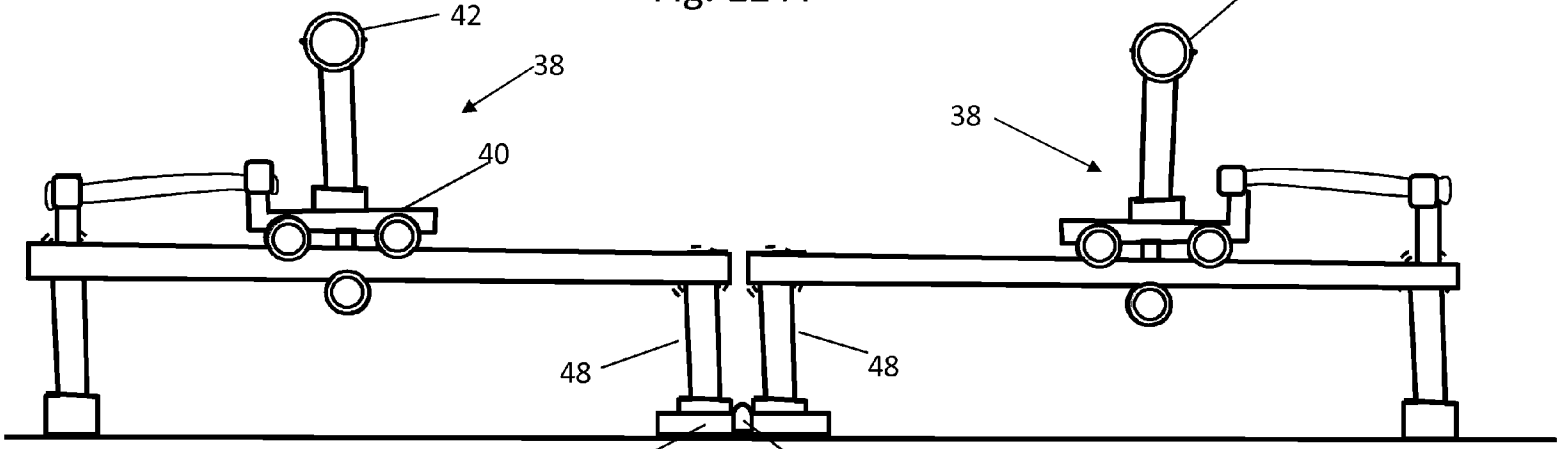
Fig. 12 B
Figs. 12

SPECIAL UPPER BODY EXERCISE DEVICE

CROSS-REFERENCE TO RELATED APPLICATIONS

This application claims the benefit of Provisional Patent Application Ser. No. 61/600,736 filed Feb. 20, 2012 by Tim Parnell and entitled "Special upper body exercise device".

FIELD OF INVENTION

This invention relates to a Special upper body exercise device. More specifically, the present invention relates to a device for performing exercises such as push-ups or the like. Particularly this apparatus relates to an isometric push-up machine. The present invention relates generally to exercise devices, and more particularly to a muscle toning exercise device that allows for the movement of the hands and arms of the user, while performing push-up type exercises in a prone position.

With the increased emphasis on overall health and conditioning, exercising is one of the foremost hobbies of society of today. In general, exercise is any type of physical activity that employs the muscles of the human body. Exercise can be obtained through sports and other physical activity that works the muscles being inclusive of weight lifting, bicycling and running. One of the most effective exercises to develop strength and conditioning of the human body is the traditional push-up. Many devices have been marketed or proposed that relate specifically to push-ups. Therefore, a need exists for a more comprehensive device that enables the user to exercise the neck muscles, the chest muscles as well as the arm muscles. Such a device should provide various adjustable parts such that the exerciser is able to select various positions, heights, angles and degrees of resistance to maximize the push-up exercise.

This invention relates to a portable exercise device with a sliding platform moving on a base structure, that can provide passive, active and resisted movement in non weight bearing exercises for the upper extremities. This invention relates particularly to a sliding arm/shoulder plate moving on a set of base sleds where the device can be used for non weight bearing active, passive, and resisted exercise to be performed for upper body extremities.

The device can be used to allow active range of motion exercises for the elbow, wrist, forearm, biceps/triceps, shoulder and upper trunk in non weight bearing situations. Passive exercises can be performed to the wrist, forearm, elbow and shoulder. Resisted exercises for the wrist, elbow, forearm, shoulder and upper trunk in a non weight bearing situations.

There are many conditions of the muscular-skeletal system that require passive, active, and/or resisted exercises as part of their rehabilitation. The exercises can be performed in non-weight bearing. The device is portable and can be used in the home, gym or rehabilitation clinic. The device can be adapted to the needs of the home/gym/or patient user. Passive movement is applied by loading the sliding hand sled so when a limb is connected to the sled, the loaded plate will passively move the limb to the extent of the resistance bands. This invention is concerned with exercise apparatus which enables a person to derive additional benefits from the exercise known as "push-ups".

FEDERALLY SPONSORED RESEARCH

None.

SEQUENCE LISTING OR PROGRAM

None.

BACKGROUND

Field of Invention and Prior Art

As far as known, there are no Special upper body exercise device or the like indicated in prior art. It is believed that this product is unique in its design and technologies.

Various kinds of muscle training apparatus and other exercising devices are well known. One of the known apparatus is U.S. Pat. No. 4,911,430 issued to Jean Marie Flament on Mar. 27, 1990 entitled "Muscle Training Apparatus" and comprising of an apparatus allowing the user to exercise for training in sliding sports such as snow or water skiing and it includes a base adapted to be anchored on a reference surface, the base. It was predominantly for movement of the lower limbs on a wheeled base and did not address the muscles and upper torso like the Parnell device. Another known muscle training device is shown in Patent Publication US20050272563 published on Dec. 8, 2005 by Yung Jen Liang and entitled "Lower muscle training device". The device was comprising a training device includes a base, and a foot support having an intermediate portion pivotally coupled to the base with a pivot shaft and having one or more foot pedals for supporting users. The foot pedals and the foot support may be rotatable relative to the base about the pivot shaft by the users, to train and exercise lower muscle groups of the users. It was a device used while seated and targeted the lower muscle groups, unlike the Parnell upper muscle focus.

Another of the known apparatus entitled "Exercise board having resilient rocker-mounting ends" is U.S. Pat. No. 6,616,583 by Louis Stack dated Sep. 9, 2003. This device was comprising of an exercise board for accommodating the foot or feet of a balancing user during exercise movement has an elongated flat platform with opposite, typically upturned ends, similar to a skateboard. The board defines an upper facing side dimensioned to receive the foot or feet of the balancing user and a lower facing side. The device was primarily focused on balance and not strengthening. It was primarily for legs unlike the device of Parnell focused on strength, repetition, and resistance training all for the upper body. A "Push Pull Type Exercising device" was taught by Alexander Agamian et al in U.S. Pat. No. 3,572,701 issued Mar. 30, 1971. It showed a rail system with bars and foot movement but no roller components or resistance bands like Parnell.

In the patent by K. L. Jennings, Sr., U.S. Pat. No. 2,666,640 granted Jan. 19, 1954 for "Exercising Stand", he discloses an appliance for raising the hands of the exerciser above the floor, thus allowing him to lower the upper portion of his body below the normal level of his shoulders when performing push-ups. His device extends the range of exercise movement to which the user can subject his body, preferably with favorable results. This had no lateral movement or resistance bands as taught by Parnell. An embellishment on the Jennings, Sr. apparatus is disclosed in U.S. Pat. No. 4,900,015, granted Feb. 13, 1990, to T. E. Dissinger, for "Exercise Device". This inventor provided a stand which requires the user to apply forces to the handgrips in the two different directions while performing push-ups. It lacked the ease of movement, the multiple bands and the roller functions disclosed by Parnell.

U.S. Pat. No. 4,720,100 was issued to Robert Du Buy, on Jan. 19, 1988 entitled "Apparatus for exercising the arm muscles". It taught an apparatus for exercising the arm muscles of the human body, whereby the apparatus comprises a base with an inclined working surface mounted above it, whose height is adjustable and which is adjoined on both sides by means of sleeves by shafts, which shafts are so mounted on the base as to be rotatable about their long axis against resistance and which are provided at their top above the working surface with transversely attached hand grips by means of which the shafts can be loaded with a torque on their long axes. It fails to show lateral movement on a prone machine as does the Parnell device.

As can be seen from the previous art and as far as known, there are no Special upper body exercise device or the like indicated in prior art. None of the known muscle training or exercising devices are suitable to effectively replace or be equivalent to the present exercise device by Parnell. Push-ups are an exercise to develop the muscles of the chest, the arms, and the shoulders. Conventionally, push-ups have been performed by the user lying face down on a flat horizontal surface and raising and lowering his body by vertically extending and contracting his arms. It is believed that this product is unique in its design and technologies.

SUMMARY OF THE INVENTION

This invention is a Special upper body exercise device. Taught here are the ways for performing exercises such as push-ups or the like. Particularly this apparatus relates to an isometric push-up machine.

The preferred embodiment is a Special upper body exercise device for use by a person, said device made of a durable material and comprised of (a) a pair of support sleds with features; (b) a pair of handles, one each for each said sled; (c) a means [such as a bushing, bearings—ball or roller, a paired pipe and sleeve with a loose fit and space between the said pipe and sleeve, etc.] to pivotally secure each respective handle to the sled; (d) a lateral support system [such as a pair of tubular and shaped rails or and enclosed track or the like]; (e) a means [such as three or four upper/lower wheels, slides and the like] for slidably connecting the support system to each of the sleds so that the sleds may move essentially in a horizontal plane in a lateral direction; and (f) a means (like rubber or synthetic bands or metal springs or the like] for resisting movement of the sleds on the support system wherein the person may grip the handles and exercise by moving the sleds laterally on the support system with the resistance means providing an exercisable resistance to the movement. In the preferred embodiment, the rail support system has telescoping rails. There are several alternative embodiments including a foldable device.

The newly invented Special upper body exercise device may be manufactured at low volumes by very simple means and in high volume production by more complex and controlled systems.

Objects and Advantages

There are several objects and advantages of the Special upper body exercise device. There are currently no known isometric or kinematic exercise devices that are effective at providing the objects of this invention.

The special upper body exercise device provide the following advantages:

1. The base width can be adjusted due to telescopic frame.
2. The sled handle attachment is never fixed in one position.
3. A push up can be executed in several positions, with user deciding on that position.
4. Pushups can be executed while hands travel parallel to the ground.
5. Resistance can be added to each sled for resistance training for interior Pectoral Development.
6. Resistance can range from one band to three bands on each end.

Finally, other advantages and additional features of the present Special upper body exercise device will be more apparent from the accompanying drawings and from the full description of the device. For one skilled in the art of exercise devices, especially for the upper body, it is readily understood that the features shown in the examples with this product are readily adapted to other types of exercise systems and devices.

DESCRIPTION OF THE DRAWINGS - FIGURES

The accompanying drawings, which are incorporated in and constitute a part of this specification, illustrate a Special upper body exercise device that is preferred. The drawings together with the summary description given above and a detailed description given below serve to explain the principles of the Special upper body exercise device for various applications. It is understood, however, that the Special upper body exercise device is not limited to only the precise arrangements and instrumentalities shown.

FIGS. 1 A through 1 E are prototypes of the general push up exercise device (PED).

Figures 2, 2A, 2B:
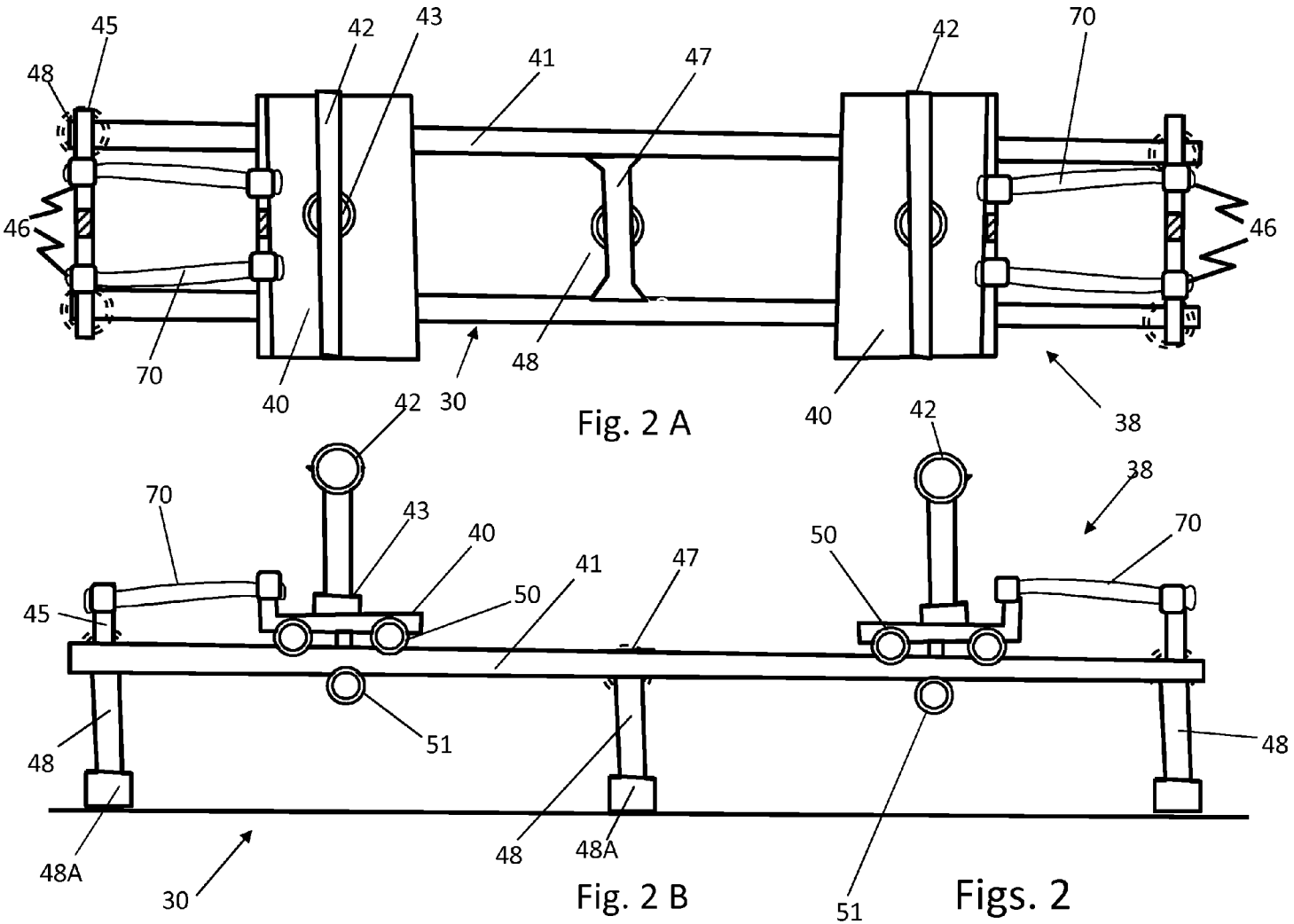

FIGS. 2 A and 2 B are sketches of the general push up exercise device with components and features noted.

Figure 3:
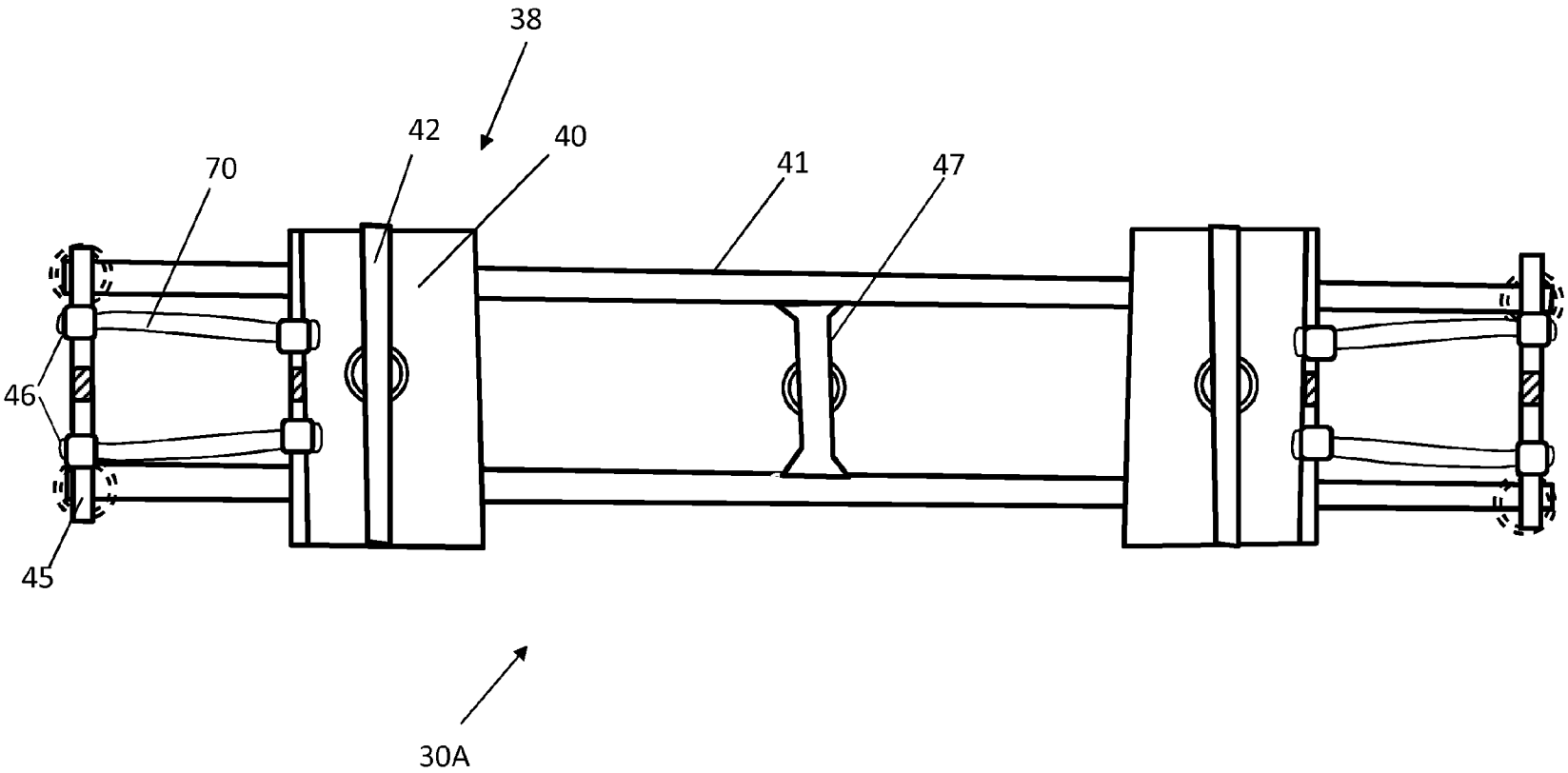

FIG. 3 is a prototype sample of the PE Device with components and features shown from generally a top view.

FIGS. 4 A through 4 D are sketches of the prototype sample with the components and features shown from generally a top, bottom, and side view.

FIGS. 5 A through 5 E are sketches of a prototype sample with the components and features including the multiple resistance bands in place.

FIGS. 6 A and 6 B are sketches demonstrating the use of the pushup exercise device.

Figures 7, 7A, 7B, 7C, 7D:
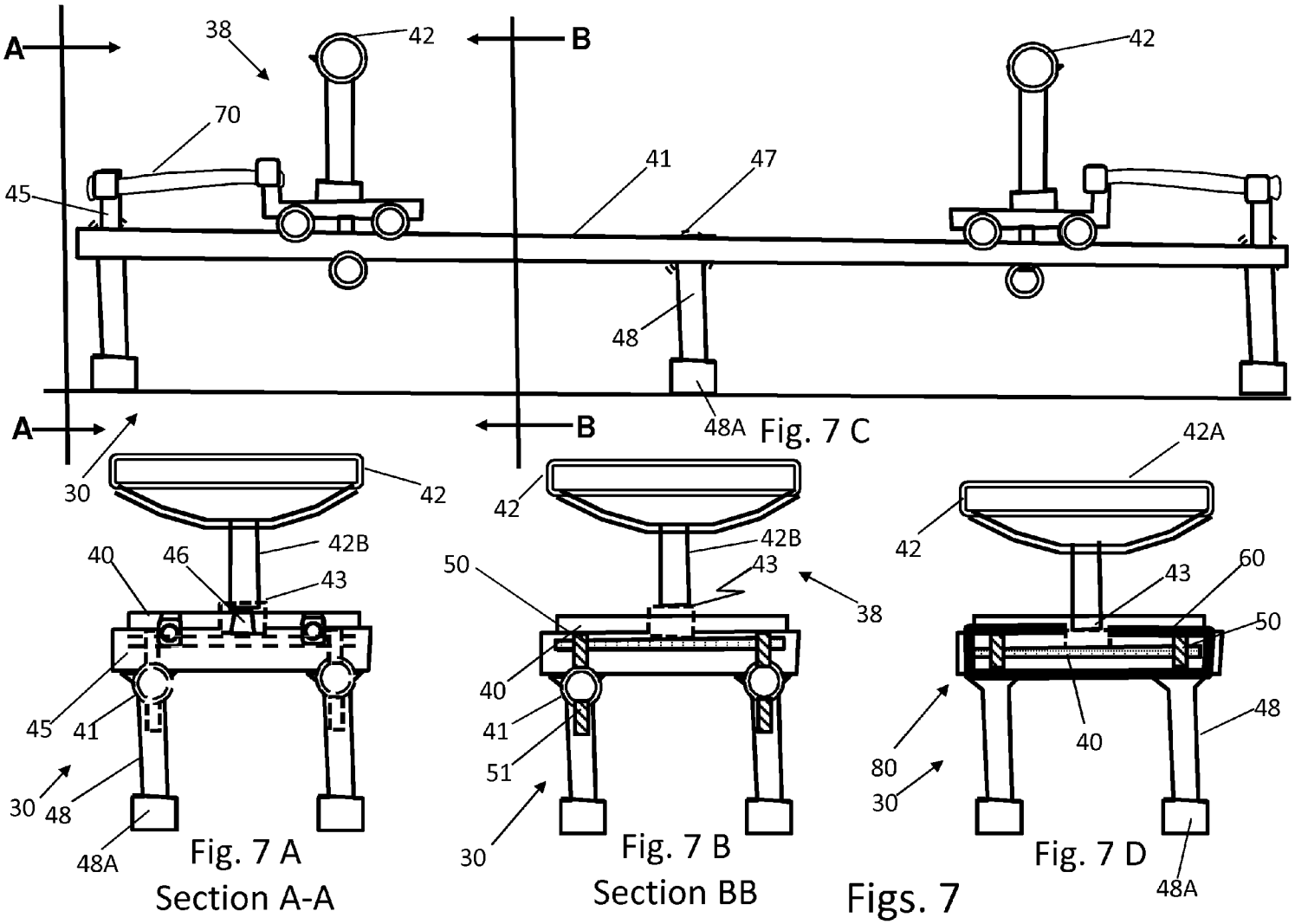

FIG. 7 A through 7 D are of the push up exercise device in conjunction with the various section views, showing components and features.

Figures 8, 8B, 8C, 8D:
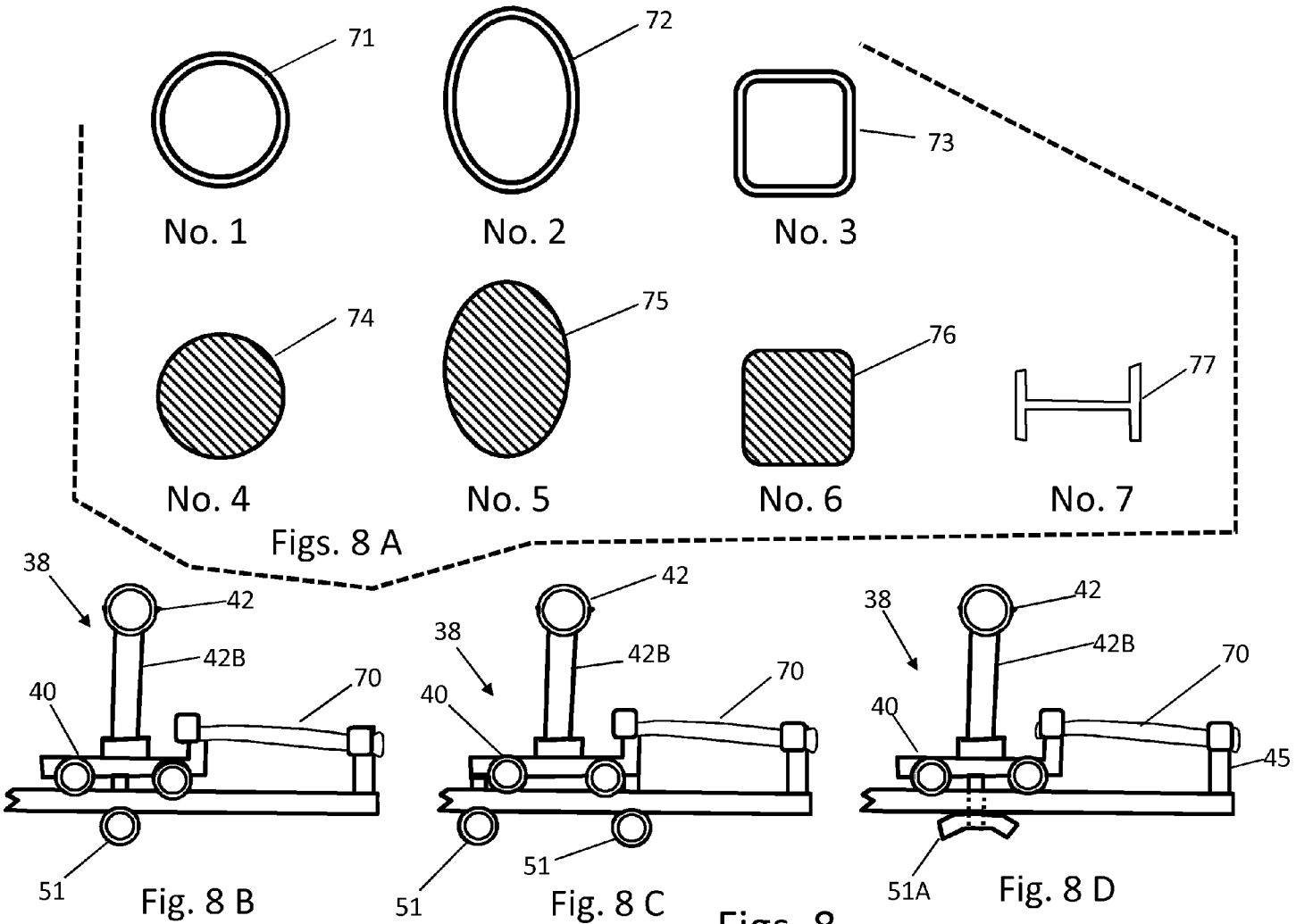

FIG. 8 A through 8 D are sketches of the push up exercise device in conjunction with alternative rail and wheel components.

FIG. 9 A through 9 C are sketches of the push up exercise device with the multiple band shown from a top view.

Figures 10, 10A, 10B, 10C, 10D, 10E, 10F:
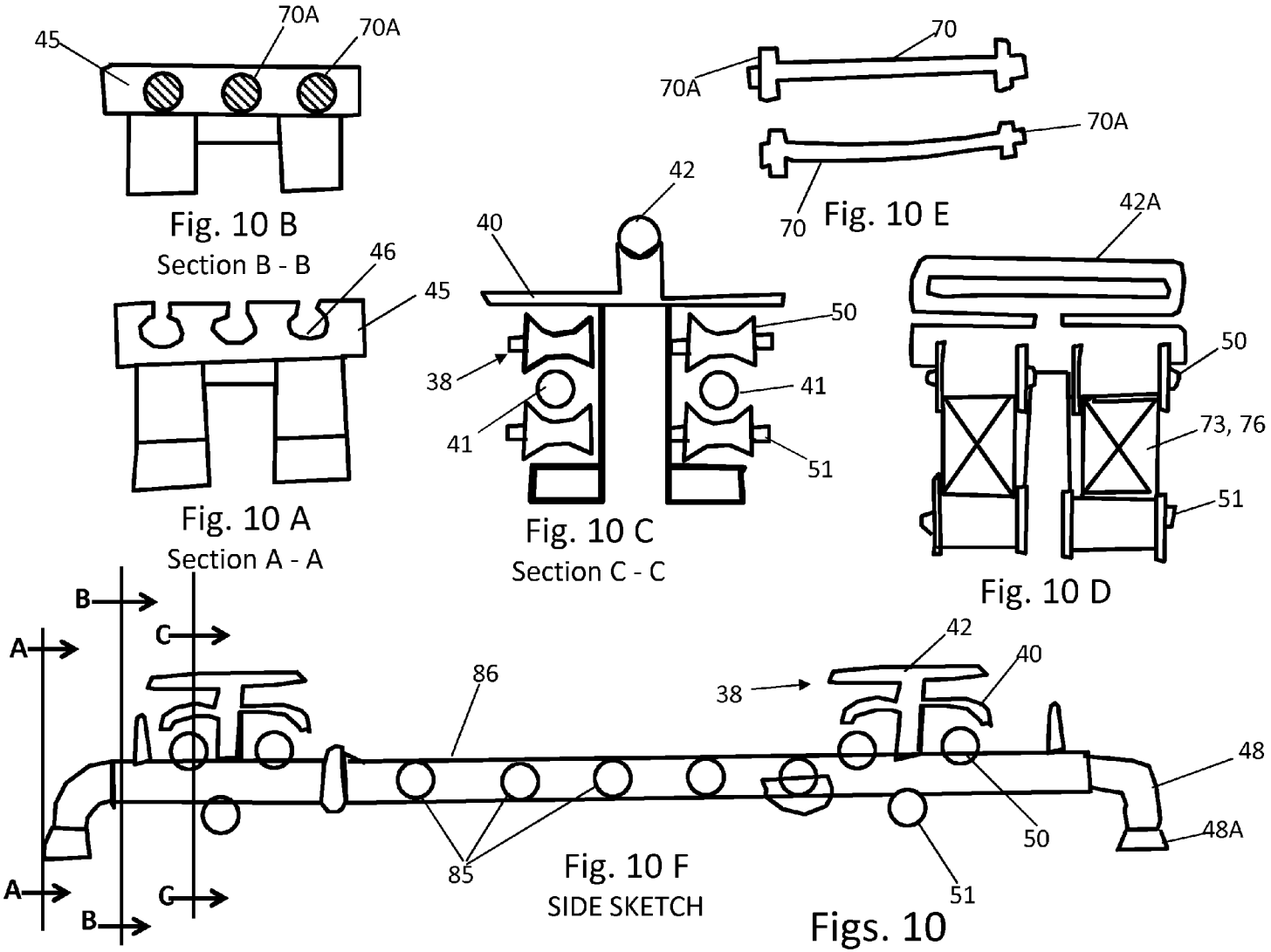

FIG. 10 A through 10 F are sketches of the push up device with the components and features shown from various views.

Figures 11, 11A, 11B, 11C, 11D:
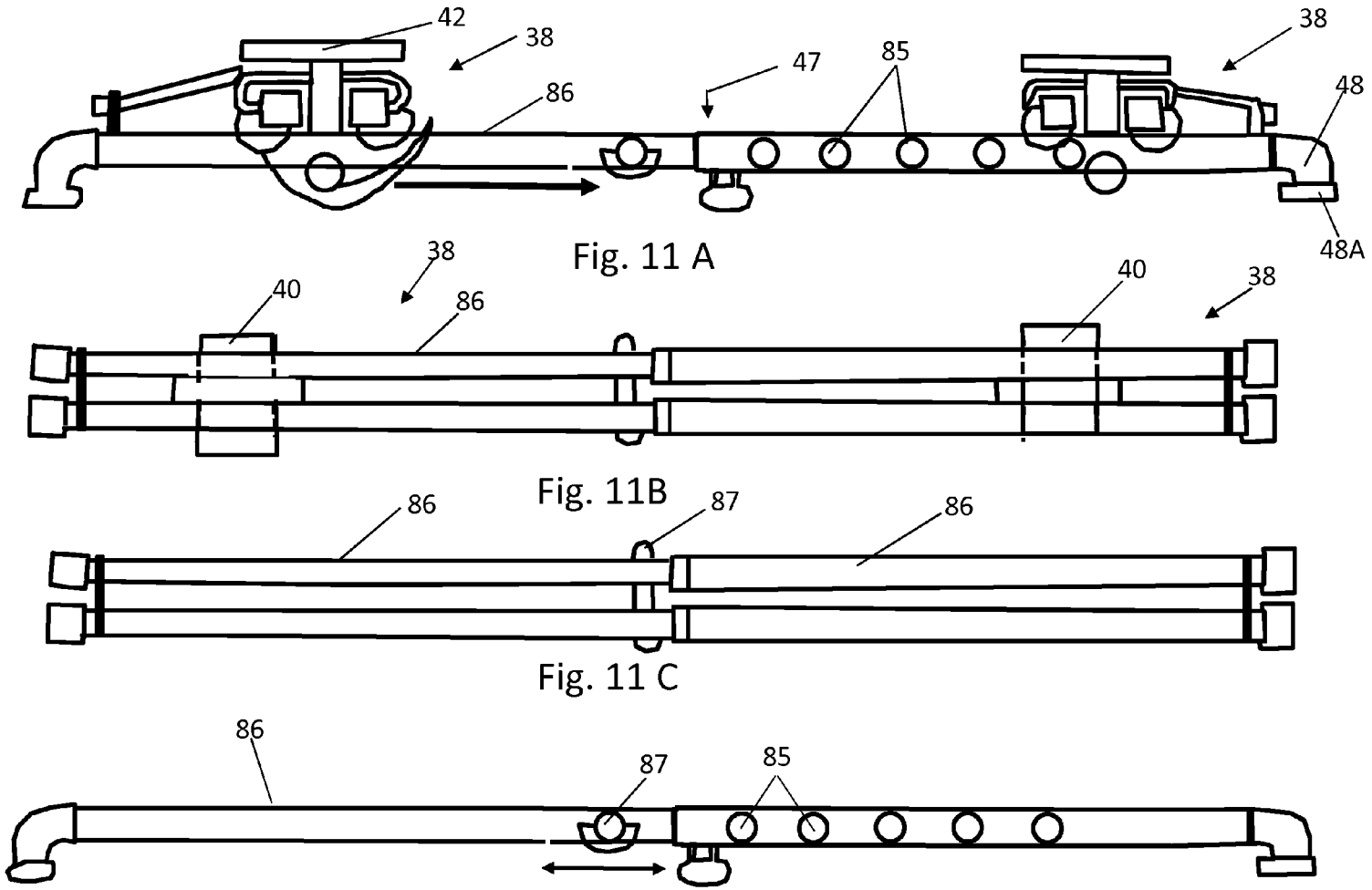

FIG. 11 A through 11 D are sketches of the push up exercise device, with components and features, from a generally side and top view.

FIGS. 12 A and 12 B are sketches of a push up exercise device with fold-up features.

REFERENCE NUMERALS

The following list refers to the drawings:

TABLE B

Reference numbers

| Ref # | Description |
|---|---|
| 30 | Push Up Exercise Device with Resistance Bands |
| 30A | Prototype Device |
| 38 | Sled Assembly |
| 40 | Sled |

TABLE B-continued

| Reference numbers | |
|---|---|
| Ref # | Description |
| 41 | Rails |
| 42 | Handle |
| 42A | Handle at Right Angle |
| 42B | Vertical Post of Handles |
| 43 | Means for Handle to (swivel) be rotatably (pivot) secured to sled |
| 45 | End Plates |
| 45A | Movable end plates with apertures that slide along the rails 41 |
| 45B | Means for movably securing endplates 45A to rail 41 (such as a removable pin 45C and several through apertures in the rail) |
| 45C | removable pin or the like |
| 46 | Band Apertures |
| 47 | Center Support |
| 48 | Vertical Floor Support |
| 48A | Protective Cups |
| 50 | Top Wheels (Slide Means) |
| 51 | Bottom Wheels (Slide Means) |
| 51A | Bottom Slide (Retention Means) |
| 60 | Closed Wheel Enclosure |
| 65 | Bottom Fold Block |
| 66 | Hinge Means |
| 70 | Resistance Bands or equivalent springs or the like |
| 70A | Means to Secure Bands in Apertures 46 |
| 71 | Rail Cross-section Hollow Round Tube |
| 72 | Rail Cross-section Hollow Elliptical Tube |
| 73 | Rail Cross-section Hollow Square or Rectangular Tube |
| 74 | Rail Cross-section Solid Round Component |
| 75 | Rail Cross-section Solid Elliptical Component |
| 76 | Rail Cross-section Solid Square or Round Component |
| 77 | Rail Cross-section I or W Structural Member |
| 80 | Rails Enclosed |
| 81 | End Plates |
| 85 | Telescopic apertures for the connection means 87 |
| 86 | Telescopic Rails |
| 87 | Split Ring Pin, spring and detent balls, pins and cotters or the like |
| 90 | Operator/Person |
| IN | Handles at Close Proximity |
| OUT | Handles at Far Proximity |
| → | Movement along a linear path |
| ↔ | |

DETAILED DESCRIPTION OF PREFERRED EMBODIMENT

The present development is a Special upper body exercise device. Particularly this product is related to a Special upper body exercise device. More specifically, the present invention relates to a device for performing exercises such as push-ups or the like. Particularly this apparatus relates to an isometric push-up machine. The present invention relates generally to exercise devices, and more particularly to a muscle toning exercise device that allows for the movement of the hands and arms of the user, while performing push-up type exercises in a prone position. This invention relates to a portable exercise device with a sliding platform moving on a base structure, which can provide passive, active and resisted movement in non weight bearing exercises for the upper extremities. This invention relates particularly to a sliding arm/shoulder plate moving on a set of base sleds where the device can be used for non weight bearing active, passive, and resisted exercise to be performed for upper body extremities.

The advantages for the Special upper body exercise device 30 are listed above in the introduction. Succinctly the benefits are that the device:

1. The base width can be adjusted due to telescopic frame.
2. The sled handle attachment is never fixed in one position.
3. A push up can be executed in several positions, with user deciding on that position.
4. Pushups can be executed while hands travel parallel to the ground.
5. Resistance can be added to each sled for resistance training for interior Pectoral Development.
6. Resistance can range from one band to three bands on each end.

The preferred embodiment is a Special upper body exercise device for use by a person, said device made of a durable material [metal, composite material, reinforced plastic, etc. and comprised of (a) a pair of support sleds 40 with features; (b) a pair of handles 42, one each for each said sled 40; (c) a means [such as a bushing, bearings—ball or roller, a paired pipe and sleeve with a loose fit and space between the said pipe and sleeve, etc.] to pivotally secure each respective handle to the sled; (d) a lateral support system 41, 43, 48 [such as a pair of tubular and shaped rails or and enclosed track or the like]; (e) a means [such as three or four upper/lower wheels, slides and the like] for slidably connecting the support system to each of the sleds so that the sleds may move essentially in a horizontal plane in a lateral direction; and (f) a means 70, 45, 46 (like rubber or synthetic bands or metal springs or the like] for resisting movement of the sleds on the support system 41 wherein the person 90 may grip the handles 42 and exercise by moving the sleds 40 laterally on the support system with the resistance means providing an exercisable resistance to the movement. In the preferred embodiment, the rail support system has telescoping rails 86. There are several alternative embodiments including a foldable device 30B.

There is shown in FIGS. 1-12 a complete description and operative embodiment of the Special heating floor mat for heavy duty applications device. In the drawings and illustrations, one notes well that the FIGS. 1 through 5 and FIGS. 7 through 12 demonstrate the general configuration and FIG. 1 E and FIG. 6 show the use of this product. The various example uses are in the operation and use section, below.

The accompanying drawings, which are incorporated in and constitute a part of this specification, illustrate an embodiment of the special upper body exercise device 30 that is preferred. The drawings together with the summary description given above and a detailed description given below serve to explain the principles of the Special upper body exercise device 30. It is understood, however, that the Special upper body exercise device 30 is not limited to only the precise arrangements and instrumentalities shown. Other examples of exercise devices and uses are still understood by one skilled in the art of exercise devices, especially for the upper body for this product and they are readily adapted to other types of exercise systems and devices to be within the scope and spirit shown here.

FIGS. 1 A through 1 E are prototypes of the general push up exercise device (PED). FIG. 1 A shows the prototype device 30A from a general TOP View. Here is shown the sleds 40, the handles 42 affixed and pivotally secured to the sleds 40, the sled assembly 38, the center support 43 and the rail system 41. FIG. 1 B shows the prototype device 30A from a generally SIDE View. The handle 42A at a right angle, the end plates 45 with the resistance bands 46, and the vertical floor supports 48 are all demonstrated along with the sled assembly 38. In FIG. 1 C, one may see an end section from a top view with the endplates 45, the slide rails 41, the sled 40 and the handle 42. FIG. 1 D shows the resistance bands 70. Finally, the FIG. 1 E shows the device 30A in use with a person 90 demonstrating the sleds 40 moving in and out as the operator 90 moves the sleds 40 by way of the handles 42 affixed to the device 30A.

FIGS. 2 A and 2 B are sketches of the general push up exercise device 30 with components and features noted from Top and Side views respectively. FIG. 2 A shows the sleds 40, the handles 42, which are pivotal or rotatably connected by a means 43 for connecting to the sled 40, the slide rails 41 on which the sleds 40 move and the center support 47 connected approximately at the midpoint of the device 30. Likewise, one may see the end plates 45 that are removably connected and secured to the rails 41. The endplates 45 have the features of the apertures 46 where the resistance bands 70 are secured to the endplates 45. One may also view the top of the vertical floor supports 48. FIG. 2 B provide a SIDE view that demonstrates the device 30 with the rails 41 supported at the ends and approximate midpoint by the vertical supports 48 with their end caps 48A that protect the floor or surface where the device 30 is resting during use. Also this view shows the sled assembly 38 and the sleds 40 with the top slide means or wheels 50 (for example and not as a limitation) and the bottom slide means or wheels 51, all wheels 50, 51 connected to the sled 40. The rotatable securing means 43 connecting the handle 42 to the sled 40 and the center support 47 are also show. The sleds 40 are removable connected to the resistance bands 70, and the bands are also removably connected to the end plates 45 at the apertures 46.

FIG. 3 is a prototype sample 30A of the PE Device with components and features shown from generally a TOP view. The rails 41, center support 47, the sled assembly 38, sled 40 and handle 42, the resistance bands 70, and the end plates 45 with apertures 46 are fully demonstrated on the prototype 30A.

FIGS. 4 A through 4 D are sketches of the prototype sample 30A of the special upper body exercise device 30 with the components and features shown from generally a top, bottom, and side view. FIG. 4 A is a view of one-half the device 30A with the sled 40, the handle 42, the rail 41, the end plate 45 with its apertures 46, and the resistance bands 70. FIG. 4 C is a side view of the prototype 30A with the sled assembly 38, the handle 42A at ninety (90) degrees, the pivotal connecting means 43 on the sled 40, and the top wheels 50 with a lower bottom slide retention means 51A. FIG. 4 B is a bottom of the device 30A with the end plates 45, retention bands 70, the vertical supports 48 and end caps 48A, the slide rails 41, the sled 40 and the bottom slide retention means 51A. FIG. 4 D shows the alternative embodiment with a feature to move the end plate 45. The end plate is now a movable end plate 45A that slides along the rails 41 and is attached by the means for movably securing 45B with a pin 45C or equal through the apertures through the rails 41. In this alternative embodiment, shorter bands 70 may be used to get the same resistance with a shorter spread distance between the sleds 40.

FIGS. 5 A through 5 E are sketches of a prototype sample 30A with the components and features including the multiple resistance bands 70 in place. FIG. 5 A shows a Top view with the end plate 45, the apertures 46, the sled 40, the handle 42 and the rails 41. FIG. 5 B demonstrates the resistance bands 70 with the end connecting means to attach to the end plates 45 and each sled 40. FIG. 5 C is a Top view with two (2) of the bands 70 shown. FIG. 5 D is a Top view with the end plate 45, the sled 40, the handle 42, the rails 41, and one (1) of the resistance bands 70 shown. FIG. 5 E is a Top view with the end plate 45, the sled 40, the handle 42, the rails 41, and three (3) of the resistance bands 70 shown.

FIGS. 6 A and 6 B are sketches demonstrating the use of the pushup exercise device. These are described below.

FIG. 7 A through 7 D are of the push up exercise device 30 in conjunction with the various section views, showing components and features. FIG. 7 C is a SIDE view of the device 30 with the sled assembly 38, the sleds 40 shown and their handles 42, and resistance bands 70 running along the rails 41, and the vertical supports 48. Shown too are the section lines for Section A-A and B-B. FIG. 7 A then shows the Section A-A with the vertical supports 48 and end caps 48A. Also is demonstrated the end plates 45 with the apertures 46. The sled assembly 38, the vertical member 42B of the handle 42 and the means 43 for pivotally connecting the handles 42B to the sled 40 is shown. FIG. 7 B is next presented with Section B-B depicted. The midsection view shows the handle 42 and vertical portion 42B connected pivotally to the sled 40 by a means 43 for connecting. Likewise the top slide means 50 or wheels and bottom slide wheels or means 51 are shown travelling along the rail section 41. FIG. 7 D is showing an alternative device 80 and a cross section with the handle 42 and vertical portion 42B connected pivotally to the sled 40 by a means 43 for connecting. However, the rails 41 are replaced by an encasement or closed wheel enclosure 60 that controls and retains the set of wheels. Abrogated is the necessity of a bottom retention wheel or means 51.

FIG. 8 A through 8 D are sketches of the push up exercise device 30 in conjunction with alternative rail and wheel components. FIG. 8 A show the possible sections being a Rail Cross-section Hollow Round Tube 71, a Rail Cross-section Hollow Elliptical Tube 72, a Rail Cross-section Hollow Square or Rectangular Tube 73, a Rail Cross-section Solid Round Component 74, a Rail Cross-section Solid Elliptical Component 75, a Rail Cross-section Solid Square or Round Component 76, and a Rail Cross-section I or W Structural Member 77. FIG. 8 B shows the sled assembly 38, a sled 40 with a single bottom means or wheel 51. FIG. 8 C shows a sled assembly 38 with a double bottom means or wheels 51. FIG. 8 D shows a sled assembly 38 with a single bottom means or slide rail 51A.

FIG. 9 A through 9 C are sketches of the push up exercise device 30 with the multiple band shown from a top view. FIG. 9 A shows the sled 40 connected to a double set of bands 70 connected to the end plates 45 and the sled 40 and the device 30 with the handle 42 essentially perpendicular to the way the rails 41 run. FIG. 9 B shows the sled 40 connected to a double set of bands 70 connected to the end plates 45 and the sled 40 and the device 30 with the handle 42 essentially parallel to the way the rails 41 run. FIG. 9 C shows the sled 40 connected to a triple set of bands 70 connected to the end plates 45 and the sled 40 and the device 30 with the handle 42 essentially perpendicular to the way the rails 41 run.

FIG. 10 A through 10 F are sketches of the push up device 30 with the sled assembly 38 and the components and features shown from various views. FIG. 10 F is a side view of the device 30 with telescopic rails 86. The rail has a series of retention apertures 85 and a detent slide pin 87 or the like to secure the rails 86 in the extended position. One sees easily how the rail spread may be adjusted for various lengths to be set for the size needed for the actual user 90. FIGS. 10 A through 10 C are Sections A-A, B-B, and C-C respectively. Here are shown the end plates 45 and apertures 46 for the bands 70; the end means 70A of the bands 70 to place and hold the bands 70 in the aperture/slots 46 of each end plate 45; the sled assembly 38, and the sled 40 with the handles 42 and the top 50 and bottom 51 wheels (means) on the rails 41. FIG. 10 D shows the wheels 50, 51 on alternative rail cross sections 73, 76. FIG. 10 E show typical resistance bands 70 with the connection means 70A and the sled assembly 38.

FIG. 11 A through 11 D are sketches of the push up exercise device 30, with components and features, from a generally side and top view. FIG. 11 A shows the sled assembly 38 on the preferred telescopic rails 86 with the features explained above. FIGS. 11 B and 11 C are TOP views of the device 30. FIG. 11 D is a side view of the telescopic rail system 86 with the adjustment features 85, 87.

FIGS. 12 A and 12 B are sketches of a push up exercise device 30 with fold-up features. FIG. 12 A is an essentially TOP view and FIG. 12 B is a side view of the device 30B. Most of the components and features are similar to other preferred devices 30. Note here the folding features with the support blocks 66, the folding means 65—such as a hinged pin, straps, clips and the like. Also, one notes the extra center supports 47, and vertical supports 48 to provide the alternative folding device 30B.

The rail 41, 86; the sled 40 and assembly 38, and the various components may be comprised of a durable and light material such as a metal like steel or aluminum and may be coated with a powder coat, paint, or other surface finish. These components may also be made of a heavy duty, durable plastic or composite material. The slides, bearings and wheels may be of various metals and composites or plastics with rolling and sliding means (ball bearings, roller bearings, bushings or bearing type slidable surfaces (Teflon® plastic, bronze, brass and the like). Any fasteners needed are means to fasten and are used to removably secure the components. The resistance bands may be various elastomeric materials, synthetic or natures, or metal springs of tight winding and high resistance.

The details mentioned here are exemplary and not limiting. Other specific components and manners specific to describing a Special upper body exercise device 30 may be added as a person having ordinary skill in the field of other types of exercise systems and devices and their uses well appreciates.

Operation of the Preferred Embodiment

The preferred embodiment is a Special upper body exercise device for use by a person, said device made of a durable material and comprised of (a) a pair of support sleds 40 with features; (b) a pair of handles 42, one each for each said sled 40; (c) a means [such as a bushing, bearings—ball or roller, a paired pipe and sleeve with a loose fit and space between the said pipe and sleeve, etc.] to pivotally secure each respective handle to the sled; (d) a lateral support system 41, 43, 48 [such as a pair of tubular and shaped rails or and enclosed track or the like]; (e) a means [such as three or four upper/lower wheels, slides and the like] for slidably connecting the support system to each of the sleds so that the sleds may move essentially in a horizontal plane in a lateral direction; and (f) a means 70, 45, 46 (like rubber or synthetic bands or metal springs or the like] for resisting movement of the sleds on the support system 41 wherein the person 90 may grip the handles 42 and exercise by moving the sleds 40 laterally on the support system with the resistance means providing an exercisable resistance to the movement. In the preferred embodiment, the rail support system has telescoping rails 86. There are several alternative embodiments including a foldable device 30B.

The Special upper body exercise device 30 operates somewhat similar to a conventional exercise devices. The operator/person 90 takes the device 30 and positions it on the floor. An exercise mat is optional for use. The user 90 then selects the number of bands 70 desired for resistance and places 0, 1, 2, or 3 at each end between the endplates 45 (in the apertures 46) and the slide assembly 38. Then the user assumes the push-up position, grips the handles 42 and operates the device. As muscle tone and capability increases, additional bands are added. The total number of bands (3) may be increased if one operator 90 wishes more resistance. Zero to 3 is a starting point/average for most users. FIGS. 6 A and 6 B are sketches demonstrating the use of the pushup exercise device 30 by the operator 90.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the Special upper body exercise device 30 is not to be limited to only the disclosed embodiment of product. The features of the Special upper body exercise device 30 are intended to cover various modifications and equivalent arrangements included within the spirit and scope of the detailed description and operation of the system presented in the above paragraphs and the accompanying drawings.

What is claimed is:

1. A Special upper body exercise device for use by a person, said device made of a durable material and comprised of:

(a) a pair of essentially horizontal support sleds with features;

(b) a pair of handles with a vertical post, one handle each for each said sled;

(c) a means to pivotally secure each of the respective handles to the sled;

(d) an essentially horizontal lateral support system further comprised having a pair of rails, the pair of rails preferably having a curved top surface and the pair of rails having an adjustable length telescopic feature;

(e) a means for slidably connecting the support system to each of the sleds so that the sleds can move essentially in a horizontal plane in a lateral direction and so that each of the pair of rails is essentially surrounded by the means for slidably connecting; and (f) a means for resisting movement of the sleds on the support system;

wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation; allowing a passive range of exercises for the wrist, forearm, elbow and shoulder; and allowing a resisted range of exercises for the wrist, elbow, forearm, shoulder and upper trunk in a non-weight bearing situation.

2. A Special upper body exercise device for use by a person, said device made of a durable material and comprised of:

(a) a pair of essentially horizontal support sleds with features;

(b) a pair of handles with a vertical post, one handle each for each said sled;

(c) a means to pivotally secure each of the respective handles to the sled, wherein the means to pivotally secure the handles is a bushing;

(d) an essentially horizontal lateral support system further comprised having a pair of rails, the pair of rails preferably having a curved top surface;

(e) a means for slidably connecting the support system to each of the sleds so that the sleds can move essentially in a horizontal plane in a lateral direction and so that each of the pair of rails is essentially surrounded by the means for slidably connecting; and (f) a means for resisting movement of the sleds on the support system;

wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation; allowing a passive range of exercises for the wrist, forearm, elbow and shoulder; and allowing a resisted range of exercises for the wrist, elbow, forearm, shoulder and upper trunk in a non-weight bearing situation.

3. A Special upper body exercise device for use by a person, said device made of a durable material and comprised of:

(a) a pair of essentially horizontal support sleds with features;

(b) a pair of handles with a vertical post, one handle each for each said sled;

(c) a means to pivotally secure each of the respective handles to the sled, wherein the means to pivotally secure the sled is a vertical pipe and vertical sleeve with a loose fit and space between the said pipe and sleeve, and wherein the sleeve is directly connected to the sled;

(d) an essentially horizontal lateral support system further comprised having a pair of rails, the pair of rails preferably having a curved top surface;

(e) a means for slidably connecting the support system to each of the sleds so that the sleds can move essentially in a horizontal plane in a lateral direction and so that each of the pair of rails is essentially surrounded by the means for slidably connecting; and (f) a means for resisting movement of the sleds on the support system;

wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation allowing a passive range of exercises for the wrist, forearm, elbow and shoulder; and allowing a resisted range of exercises for the wrist, elbow, forearm, shoulder and upper trunk in a non-weight bearing situation.

4. A Special upper body exercise device for use by a person, said device made of a durable material and comprised of:

(a) a pair of essentially horizontal support sleds with features;

(b) a pair of handles with a vertical post, one handle each for each said sled;

(c) a means to pivotally secure each of the respective handles to the sled;

(d) an essentially horizontal lateral support system further comprised having a pair of rails, the pair of rails preferably having a curved top surface;

(e) a set of two top rollers and a bottom slide piece, wherein the set of two top rollers and the bottom slide piece essentially surround each of the pair of rails so that the sleds can move essentially in a horizontal plane in a lateral direction; and (f) a means for resisting movement of the sleds on the support system;

wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation; allowing a passive range of exercises for the wrist, forearm, elbow and shoulder; and allowing a resisted range of exercises for the wrist, elbow, forearm, shoulder and upper trunk in a non-weight bearing situation.

5. A Special upper body exercise device for use by a person, said device made of a durable material and comprised of:

(a) a pair of essentially horizontal support sleds with features;

(b) a pair of handles with a vertical post, one handle each for each said sled;

(c) a means to pivotally secure each of the respective handles to the sled;

(d) an essentially horizontal lateral support system further comprised having a pair of rails, the pair of rails preferably having a curved top surface;

(e) a means for slidably connecting the support system to each of the sleds so that the sleds can move essentially in a horizontal plane in a lateral direction and so that each of the pair of rails is essentially surrounded by the means for slidably connecting; and (f) a means for resisting movement of the sleds on the support system, wherein the resistance means is a pair of movably, securable end plates and a set of resistance bands at each end of the device;

wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation; allowing a passive range of exercises for the wrist, forearm, elbow and shoulder; and allowing a resisted range of exercises for the wrist, elbow, forearm, shoulder and upper trunk in a non-weight bearing situation.

6. A Special upper body exercise device for use by a person, said device made of a durable material and comprised of:

(a) a pair of essentially horizontal support sleds;

(b) a pair of handles with a vertical post, one handle each for each said sled;

(c) a bushing to pivotally secure each respective handle to the sled;

(d) an essentially horizontal pair of rails for supporting each of the sleds the pair of rails preferably having a curved top surface;

(e) a means for slidably connecting the support system to the sleds comprised of a set of two top rollers and a single bottom roller, the three rollers supporting each of the sleds as the sleds can move essentially in a horizontal plane in a lateral direction and wherein the set of two top rollers and the single bottom roller essentially surround each of the pair of rails; and (f) a means for resisting movement of the sleds on the support system comprised of three bands at each end, wherein the person may grip the handles and exercise by moving the sleds laterally on the support system with the resistance means providing an exercisable resistance to the movement thereby allowing an active range of motion exercises for the elbow, wrist, forearm, biceps/triceps, shoulder and upper trunk in a non-weight bearing situation; allowing a passive range of exercises for the wrist, forearm, elbow and shoulder; and allowing a resisted range of exercises for the wrist, elbow, forearm, shoulder and upper trunk in a non-weight bearing situation.

* * * * *